US012140323B1

(12) United States Patent
Goodman et al.

(10) Patent No.: US 12,140,323 B1
(45) Date of Patent: Nov. 12, 2024

(54) SELF-CONTAINED MINI-SPLIT HEATING, VENTILATION AND AIR CONDITIONING (HVAC) SYSTEM

(71) Applicant: Karogen LLC, Delray Beach, FL (US)

(72) Inventors: Kathy E. Goodman, Delray Beach, FL (US); Robert Sunstone, North Palm Beach, FL (US)

(73) Assignee: KAROGEN LLC, Delray Beach, FL (US)

( * ) Notice: Subject to any disclaimer, the term of this patent is extended or adjusted under 35 U.S.C. 154(b) by 0 days.

(21) Appl. No.: 18/592,611

(22) Filed: Mar. 1, 2024

Related U.S. Application Data

(60) Provisional application No. 63/581,091, filed on Sep. 7, 2023, provisional application No. 63/580,391, filed on Sep. 4, 2023.

(51) Int. Cl.
*F24F 1/0003* (2019.01)

(52) U.S. Cl.
CPC ..... *F24F 1/0003* (2013.01)

(58) Field of Classification Search
CPC .. F24F 1/0003; F24F 1/02; F24F 1/027; F24F 1/022; F24F 1/03; F24F 1/031; F24F 1/62
See application file for complete search history.

(56) References Cited

U.S. PATENT DOCUMENTS 3,052,104 A * 9/1962 Carini ..... F24F 1/0323 62/262
3,123,987 A * 3/1964 Moore ..... F24F 1/031 62/263
3,221,512 A * 12/1965 Bakos ..... F24F 1/031 62/429
3,308,634 A * 3/1967 Smith ..... F24F 13/20 62/263
3,309,889 A * 3/1967 Copp, Jr. ..... F24F 1/031 62/262
3,392,546 A * 7/1968 Reed ..... F24F 7/013 62/262
3,416,329 A * 12/1968 Thomas ..... F24F 1/029 62/262
3,438,219 A * 4/1969 Brugler ..... F24F 1/029 62/448
3,448,590 A * 6/1969 Eberhart ..... F24F 1/031 62/262
3,990,261 A * 11/1976 Smith ..... F24F 1/0323 62/262
4,051,693 A * 10/1977 Needham ..... F24F 1/035 62/262
4,370,863 A * 2/1983 Fisher ..... F25B 39/04 62/506
2022/0120450 A1* 4/2022 Wu ..... F24F 13/24

* cited by examiner

*Primary Examiner* — Travis Ruby
(74) *Attorney, Agent, or Firm* — Peter J. Van Bergen

(57) ABSTRACT

A self-contained HVAC system is a single structure having a sequential arrangement of coupled housings. At least two housings are offset with respect to one another in two dimensions. HVAC components are disposed throughout and within the coupled housings. The HVAC components include operational components interconnected by electrical lines and fluid-carrying lines where the HVAC components are operable to generate at least one of heated air and cooled air.

21 Claims, 9 Drawing Sheets

SELF-CONTAINED MINI-SPLIT HEATING, VENTILATION AND AIR CONDITIONING (HVAC) SYSTEM

Pursuant to 35 U.S.C. § 119, the benefit of priority from provisional application 63/580,391, with a filing date of Sep. 4, 2023, and provisional application 63/581,091, with a filing date of Sep. 7, 2023, are claimed for this non-provisional application.

FIELD OF THE DISCLOSURE

This disclosure relates generally to heating, ventilation and air conditioning (HVAC) systems, and more particularly to methods and systems for self-contained mini-split HVAC systems that eliminate the need for electrical and fluid-carrying line connections at installation.

BACKGROUND

The effects of climate change require innovations in a variety of fields in order to reduce the generation of greenhouse gases. The greatest opportunities for greenhouse gas reduction exist in fields such as transportation, energy, and construction. For example, in the construction field, the vast majority of residential and commercial buildings are designed and constructed to include a centralized heating, ventilation and air conditioning (HVAC) system using one or more centrally-located furnaces, compressors, heat pumps, etc., whose generated heated or cooled air is blown through a duct system to the various rooms of a building.

There are numerous inefficiencies associated with centralized HVAC systems. Designs of such systems require experts trained in evaluating a number of complex relationships to generate a generalized approach that may or may not be appropriate for a particular building structure, location, etc. Installation and maintenance of such systems also require trained expert technicians whose on-site work is subject to technician availability as well as their human error in judgement or performance that can result in horrendously inefficient and/or poorly performing HVAC systems. In addition, the extensive use of duct work in centralized HVAC systems guarantees some degree of thermal and air-flow loss as well as the very common problem of some rooms being poorly heated/cooled as compared to other rooms in a building. The nature of centralized HVAC systems also requires the in-situ connection of lines (e.g., electrical, refrigerant, drain, etc.) and charging of the HVAC system with refrigerant where line-connection errors may result in refrigerant leaks, drain line leaks, and/or difficult-to-diagnose electrical issues. Finally, the very nature of a centralized HVAC system leads to inherent energy-usage inefficiencies as an entire building is heated/cooled even if only a part of it is being used/occupied. Such energy-usage inefficiencies result in unnecessary greenhouse gas production.

To avoid the inefficiencies and cost associated with central/ducted HVAC systems, several room-type HVAC systems are available. Conventional window or floor HVAC systems are box-like structures installed in a window or hole in a wall, respectively. However, these types of HVAC systems tend to be loud and inefficient owing to their placement of noise-generating components and required venting between the outside and inside environments. More recently, ductless mini-split HVAC systems have been developed. Such mini-split systems include an outside unit and an inside unit attached to an inside wall. Electrical and fluid-carrying lines (e.g., refrigerant lines, drain lines, vacuum lines, etc.) that interconnect the outside and inside units require installation on-site by a professional HVAC technician. Thus, conventional mini-split systems suffer from the same technician-requirement drawbacks associated with central/ducted HVAC systems described above.

SUMMARY

Accordingly, it is an object of the present disclosure to describe methods and systems for efficient heating, ventilation and air conditioning (HVAC).

Another object of the present disclosure is to provide methods and systems for self-contained HVAC that may be readily installed in a room of a building.

Still another object of the present disclosure is to provide methods and systems for a self-contained mini-split HVAC that is completely prefabricated with its electrical and fluid-carrying lines being connected in a controlled factory environment such that installation in a room of a building is simple mechanical operation.

Other objects and advantages of the methods and systems described herein will become more obvious hereinafter in the specification and drawings.

In accordance with methods and systems described herein, a self-contained heating, ventilation, and air conditioning (HVAC) system includes a single structure having a sequential arrangement of coupled housings. At least two housings from the coupled housings are offset with respect to one another in two dimensions. HVAC components are disposed throughout and within the coupled housings. The HVAC components include operational components interconnected by electrical lines and fluid-carrying lines where the HVAC components are operable to generate at least one of heated air and cooled air.

BRIEF DESCRIPTION OF THE DRAWINGS

Other objects, features and advantages of the methods and systems described in the present disclosure will become apparent upon reference to the following description of the preferred embodiments and to the drawings, wherein corresponding reference characters indicate corresponding parts throughout the several views of the drawings and wherein.

DETAILED DESCRIPTION

Figure 1:
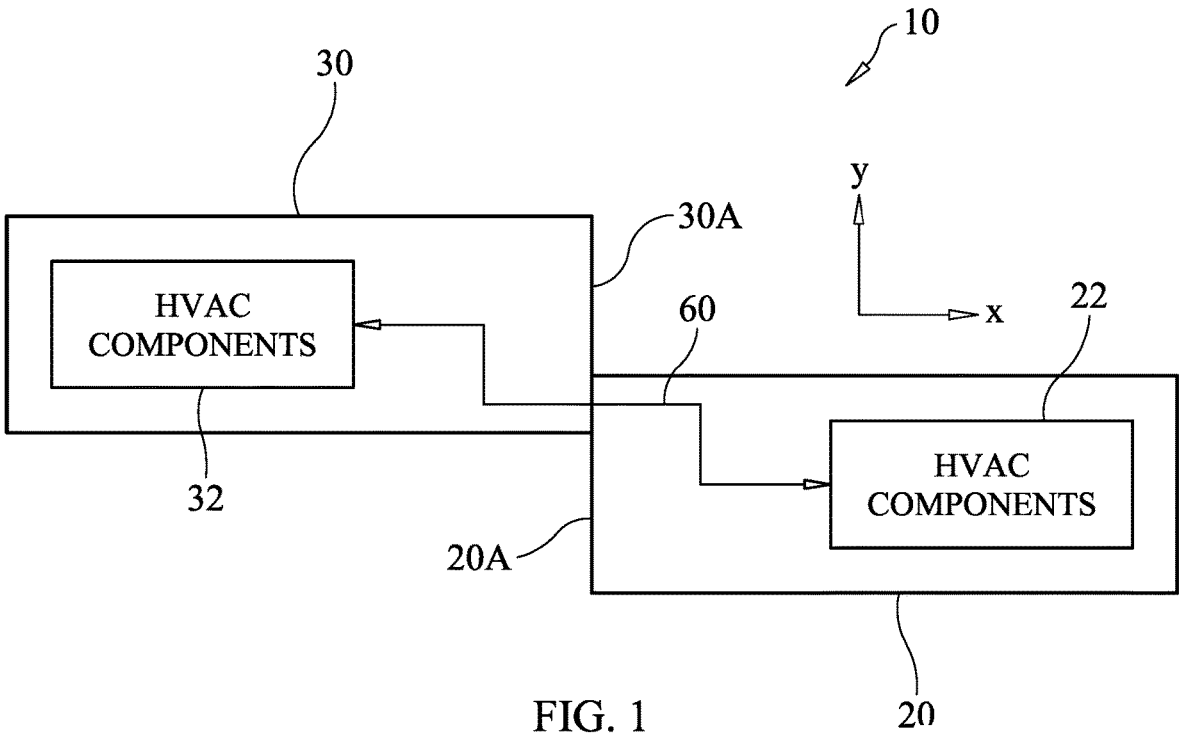
FIG. 1 is a schematic view of an embodiment of a self-contained mini-split heating, ventilation and air conditioning (HVAC) system in accordance with various aspects as described herein.

Referring now to the drawings and more particularly to FIG. 1, a schematic view of an embodiment of a self-contained mini-split heating, ventilation and air conditioning (HVAC) system in accordance with the present disclosure is illustrated and is referenced generally by numeral 10. As used herein, the term "self-contained" refers to a ductless HVAC system that is prefabricated to be completely operational. That is, the prefabricated HVAC system only requires a simple mechanical installation in a building without the need to make any on-site electrical-line or fluid-line connections between HVAC components of the HVAC system. For example, all internal electronics, electrical line, refrigerant line, drain line, vacuum line, etc., connections are made and sealed (where appropriate) in a factory setting. In addition, any refrigerant lines to include coils coupled thereto in HVAC system 10 are fully charged with an appropriate refrigerant as part of HVAC system 10 prior to the system's installation in a building.

Power for HVAC system 10 may be supplied via one or more of a conventional electric cord (not shown) coupled to HVAC system 10, an internal battery (not shown), a solar collector (not shown), etc. Accordingly, it is to be understood that the power system(s) for HVAC system 10 as well as any internal and/or user-controllable electronics associated therewith are not limitations of the present disclosure.

Figure 2:
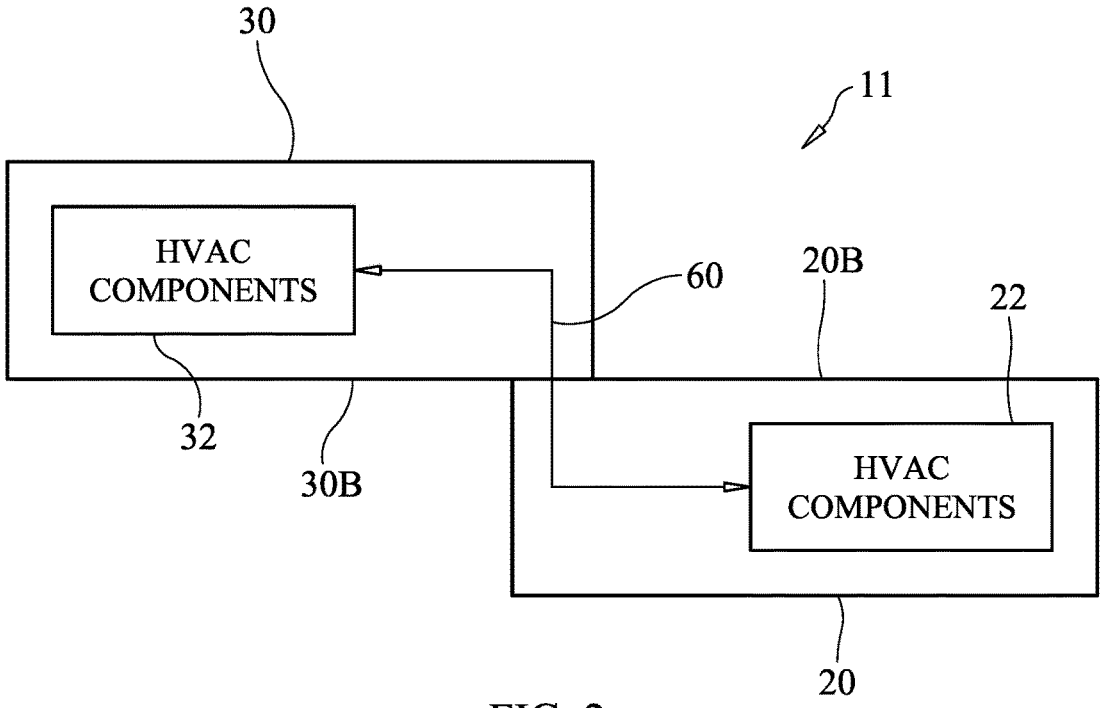
FIG. 2 is a schematic view of another embodiment of a self-contained mini-split HVAC system in accordance with various aspects as described herein.
Figure 3:
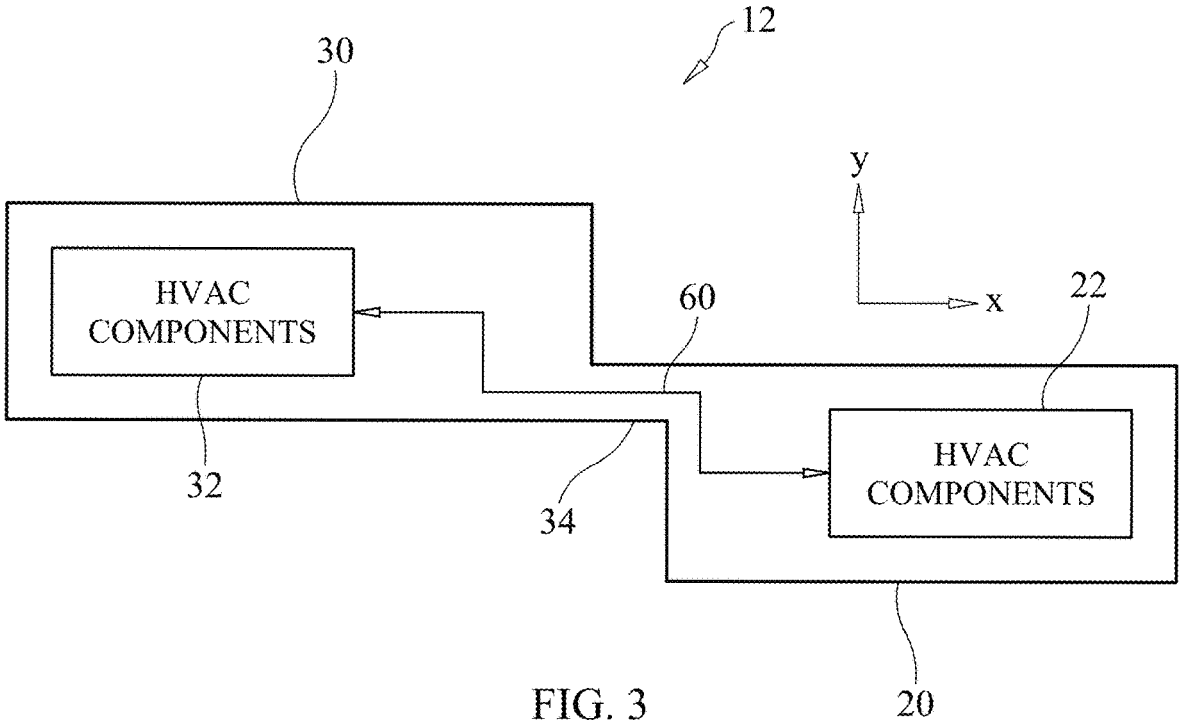
FIG. 3 is a schematic view of another embodiment of a self-contained mini-split HVAC system in accordance with various aspects as described herein.

In the illustrated embodiment, HVAC system 10 is a single structure that includes two housings 20 and 30 arranged sequentially with HVAC components 22 and 32 respectively disposed in housings 20 and 30. Briefly, housings 20 and 30 are adjacent and coupled to one another (e.g., attached to one another, integrated with one another, etc.) at side edges 20A and 30A, respectively, such that housings 20 and 30 define a unitary structure. In some embodiments and as illustrated in FIG. 2 for an HVAC system 11, the system's single structure has housings 20 and 30 adjacent and coupled to one another at face edges 20B and 30B, respectively. In some embodiments and as illustrated in FIG. 3 for an HVAC system 12, housing 30 may include a rigid conduit 34 to rigidly connect to housing 20. Conduit 34 may provide one or more of a variety of functions to include protection of electrical or fluid-carrying lines passing there through, facilitating manipulation of HVAC system 12 during its installation, increasing the spacing between housing 20 and housing 30, etc. In accordance with the present disclosure, each HVAC system's housings 20 and 30 are offset with respect to one another in two dimensions (e.g., the x and y dimensions in the illustrated embodiment) for each of HVAC systems 10, 11, or 12. In some embodiments, the two dimensions of the housing offset may be orthogonal to one another.

In some embodiments, housings 20 and 30 are coupled in a rigid fashion such that the sequential arrangement of the housings is a rigid structure. In some embodiments and as will be described further below, one or more of the housing couplings may be made in a way that allows for hinged movement between the coupled housings. In all embodiments, housings 20 and 30 may include vents (not shown) to allow air to flow into and out of the HVAC system as would be understood by one of ordinary skill in the art.

As mentioned above, each of HVAC systems 10-12 includes HVAC components 22 and 32 disposed in housings 20 and 30, respectively. That is, HVAC components 22 are disposed in housing 20, and HVAC components 32 are disposed in housing 30. HVAC components 22 and 32 may include any of the components needed for an operational HVAC system such as compressors, condensers, coils, evaporators, reversing valves, fans, sensors, switches, power supplies, control electronics, electrical lines connecting the various components, fluid-carrying lines (e.g., refrigerant lines, drain lines, vacuum lines, etc.) coupled to and/or extending from various components, etc., as would be well-understood in the art of HVAC systems. The arrangement of components 22 and 32 may be optimized for a type of application, for maintenance planning, for weight distribution, etc. Therefore, it is to be understood that the types and positioning of the various HVAC components disposed in housings 20 and 30 are not limitations of the present disclosure. However and as will be explained later herein, there are advantages to placing the HVAC system's compressor (not specifically shown in FIGS. 1-3) in the housing that will be positioned on the exterior of a building.

For purpose of the present disclosure, the various electrical and/or fluid-carrying lines extending between and coupling various ones of HVAC components 22 and 32 are considered to be part of the HVAC components. For purposes of illustration, the various electrical and/or fluid-carrying lines are indicated in FIGS. 1-3 by two-headed arrows 60. The protected and/or sealed passage of connecting lines 60 through/between housings 20 and 30 may be accomplished in a variety of ways without departing from the scope of the present disclosure. In all embodiments described herein, housings 20 and 30 along with their respective HAVC components 22 and 32 to include their connecting lines 60 define a prefabricated and self-contained HVAC system that is operable to provide heated or cooled air once powered and activated. For clarity of illustration, HAVC components 22 and 32 to include their connecting lines 60 will be omitted from the remainder of the figures used to describe the methods and systems of the present disclosure.

Figure 4A:
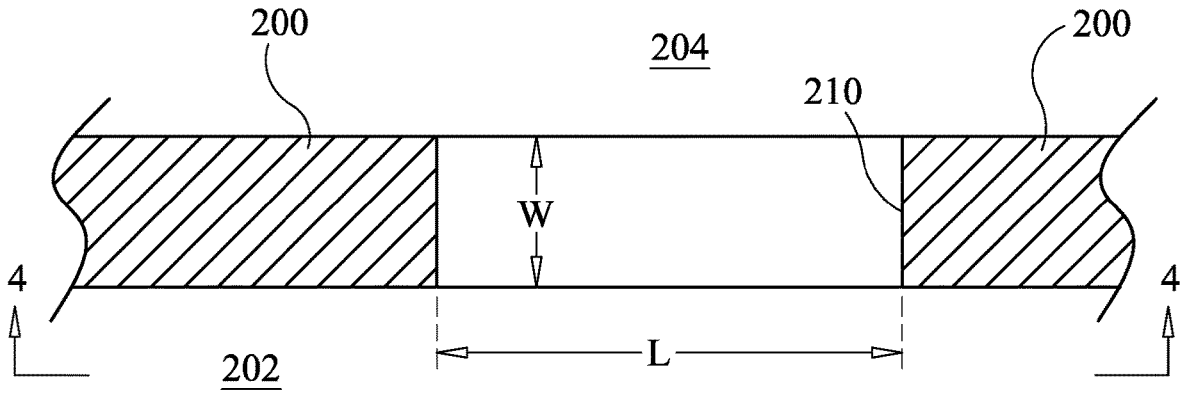
FIG. 4A is an isolated cross-sectional view of a portion of a solid exterior-to-interior interface of a building provided with a hole used for an installation of a self-contained mini-split HVAC system in accordance with various aspects as described herein.
Figure 4B:
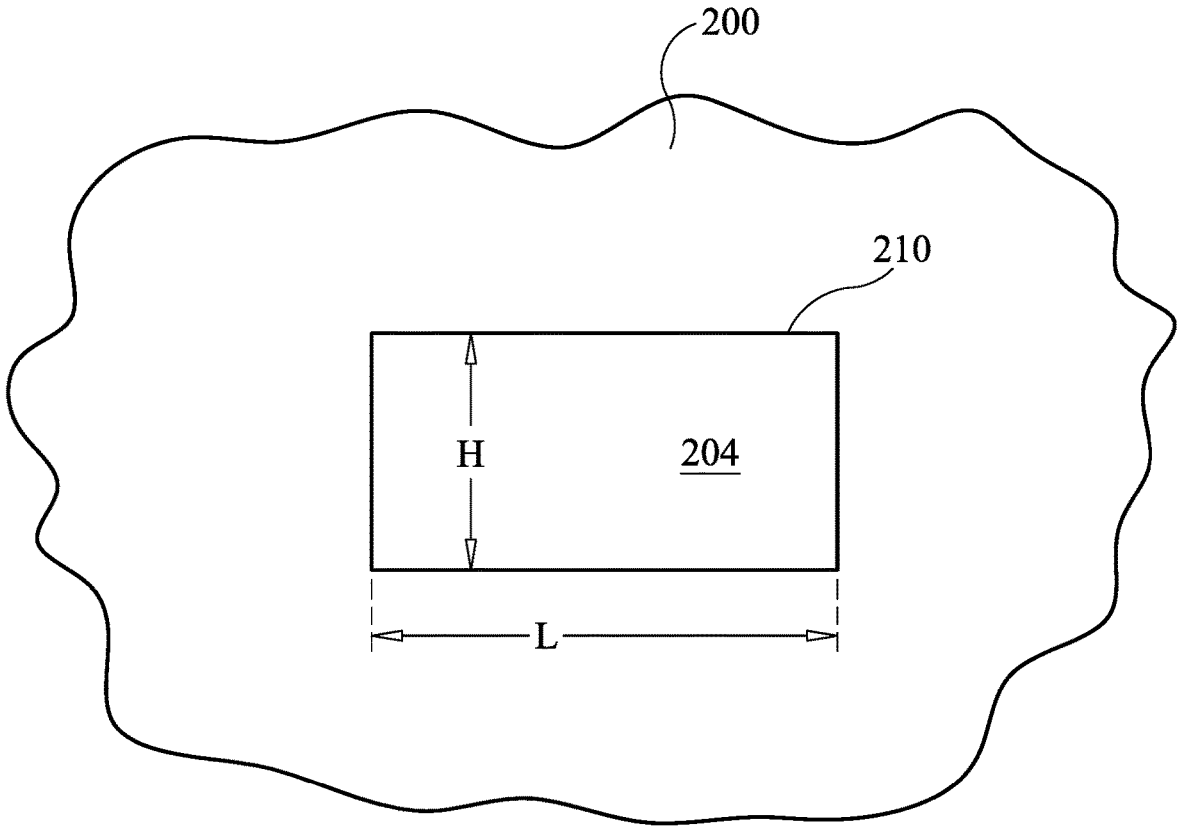
FIG. 4B is a plan view of the portion of the solid exterior-to-interior interface of a building taken along line 4-4 in FIG. 4A.

Referring now simultaneously to FIGS. 4A and 4B, an isolated view of a portion of an exterior-to-interior interface of a building where HVAC system 10, 11, or 12 is to be installed is illustrated in a cross-sectional view (FIG. 4A) and a plan view (FIG. 4B) taken along line 4-4 in FIG. 4A. The exterior-to-interior interface is referenced by numeral 200. In general, the exterior-to-interior interface 200 used for installation is any solid portion of a building that defines an interface between an exterior region 202 (e.g., an ambient-temperature region such as an outdoor environment) and an interior region 204 of the building that is to be heated/cooled by, for example, the above-described HVAC system 10. Interface 200 may be a wall, a door, etc., the choice of which is not a limitation of the present disclosure.

Interface 200 is provided with a mounting hole 210 that may be a design feature for new construction or may be a post-construction modification cut out of interface 200. Referring to the view in FIG. 4A, the thickness or width of hole 210 is indicated by "W" and its length is indicated by "L". Referring to the plan view in FIG. 4B (as viewed from the exterior region 202), the height of hole 210 is indicated by "H". In general, the width, length, and height dimensions of hole 210 are sized to cooperate with the size and configuration of HVAC system 10, 11, or 12 to provide for the maneuvering of the HVAC system through hole 210 during installation as will be described further below.

Figure 5A:
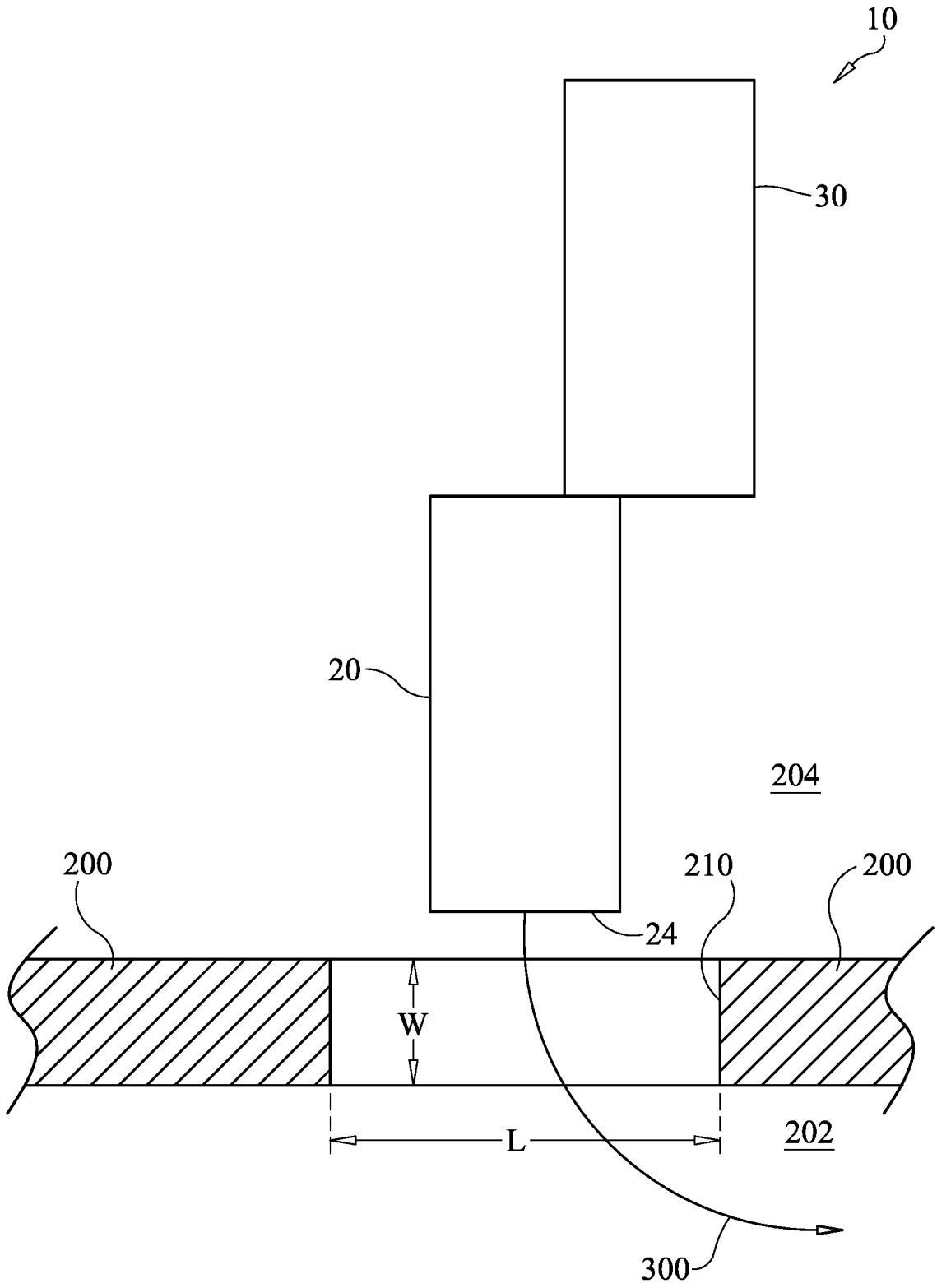
FIG. 5A illustrates the HVAC system shown in FIG. 1 just prior to its installation in a solid exterior-to-interior interface of a building by an installation method in accordance with various aspects as described herein.
Figure 5B:
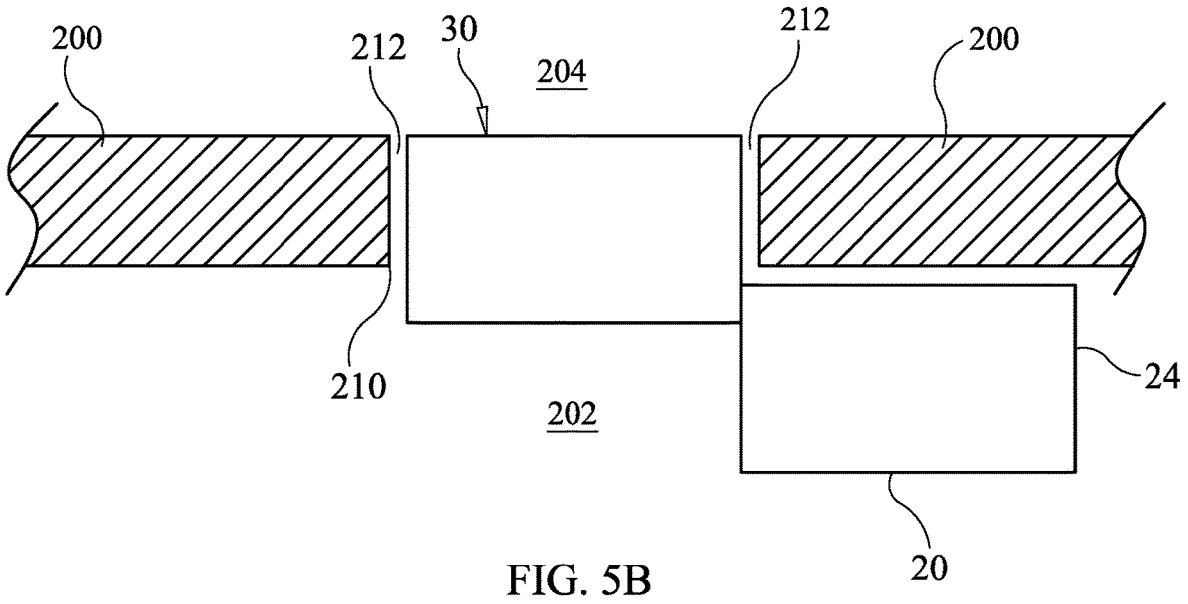
FIG. 5B illustrates the HVAC system shown in FIG. 1 after its installation in a solid exterior-to-interior interface of a building in accordance with various aspects as described herein.

Referring now simultaneously to FIGS. 5A and 5B, HVAC system 10 is illustrated just prior to installation in hole 210 of interface 200 (FIG. 5A), and after its installation in hole 210 of interface 200 (FIG. 5B). In general, the above-described offset relationship between housings 20 and 30 facilitates the maneuvering of HVAC system 10 into its installation position shown in FIG. 5B. In the illustrated example, it is assumed that housings 20 and 30 are rigidly coupled to one another where they meet, and that HVAC system 10 will be maneuvered through hole 210 from the interior region 204.

As shown in FIG. 5A, an outboard end 24 of housing 20 serves as the leading edge of HVAC system 10 as it is maneuvered along an installation path indicated by path arrow 300. At the completion of such maneuvering, housing 20 is positioned in exterior region 202 and housing 30 is disposed in hole 210. HVAC system 10 may be configured such that housing 20 fits through hole 210, while housing 30 fits in hole 210. In some embodiments, housing 30 may substantially fill hole 210 as is the case in the illustrated example. It is to be understood that housing 30 may extend partially into exterior region 202 and/or partially into interior region 204 without departing form the scope of the present disclosure. Once HVAC system 10 is positioned as illustrated in FIG. 5B, HVAC system 10 may be secured to interface 200 in a variety of ways (not shown) without departing form the scope of the present disclosure. Although HVAC system 10 is illustrated as being horizontally oriented in FIG. 5B, it is to be understood that HVAC system 10 may be configured for a vertically-oriented installation without departing from the scope of the present disclosure. A similar installation process may be used for either of the other above-described HVAC systems 11 or 12.

Following installation of HVAC system 10, any remaining open region(s) 212 of hole 210 adjacent to housing 30 may be finished, filled, etc., in a variety of ways without departing form the scope of the present disclosure. In some embodiments, open region(s) 212 may be filled with one or more types of insulation (e.g., thermal, moisture, acoustic, and/or vibration insulation). In some embodiments, open region(s) 212 may be finished cosmetically at the portion of interface 200 facing interior region 204.

Figure 6:
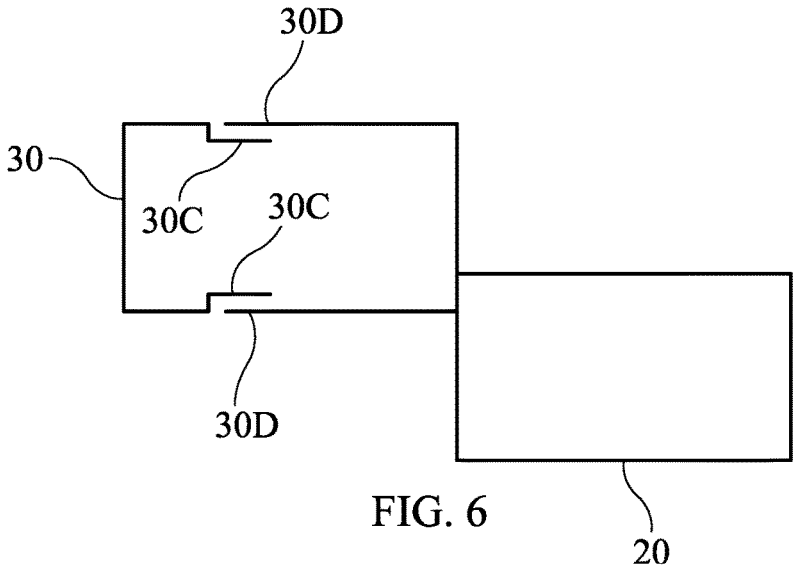
FIG. 6 illustrates another embodiment of a self-contained mini-split HVAC system having a housing that is adjustable in one or more dimensions in accordance with various aspects as described herein.

In some embodiments, the single-structure configuration of an HVAC system in accordance with the present disclosure may be modified to allow the system's housing 30 (i.e., the one that will reside in an interface's hole) to be adjusted in one or more dimensions (e.g., length, width) to accommodate an installation fit and/or improve the system's maneuverability during installation. For example and as shown in FIG. 6, housing 30 may be configured to have telescopic sections 30C and 30D to allow the dimensions of housing 30 to be adjusted as needed in terms of the housing's length and/or width.

Figure 7:
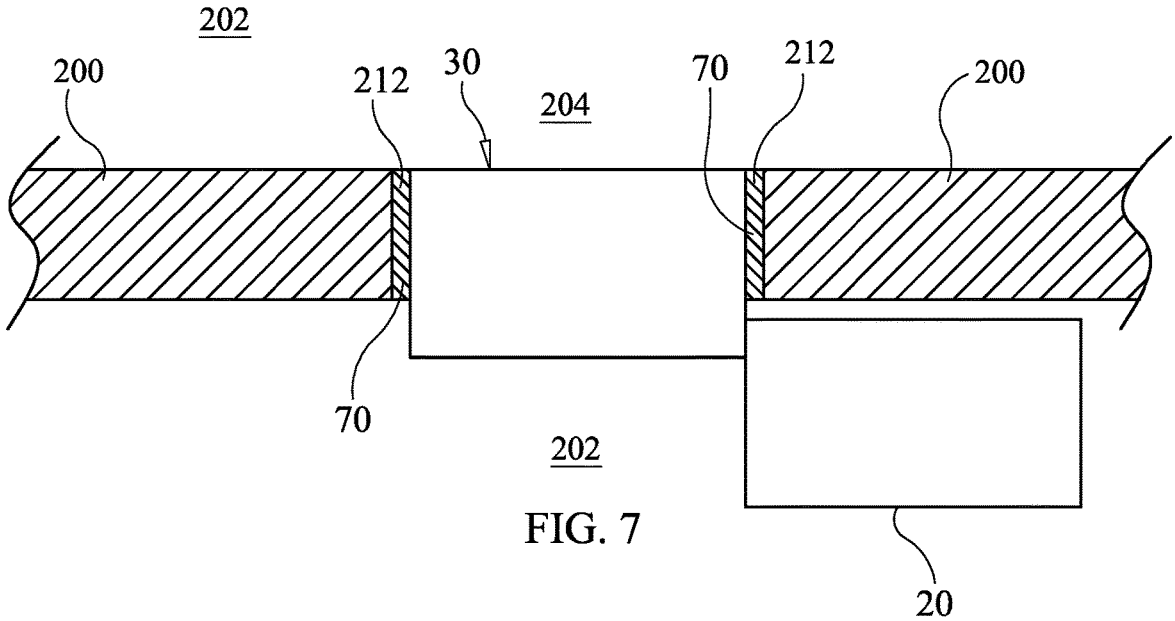
FIG. 7 illustrates another embodiment of a self-contained mini-split HVAC system installed in a solid exterior-to-interior interface of a building having insulation disposed about the HVAC system's housing that is disposed in the interface of the building in accordance with various aspects as described herein.

In some embodiments and as mentioned above, insulation may be provided about housing 30 in open region(s) 212 as illustrated in FIG. 7. Insulation 70 may include thermal, moisture, acoustic, and/or vibration insulation. In some embodiments, insulation 70 may be coupled to housing 30 in the prefabricated state of the HVAC system such that insulation 70 is part of the HVAC system's single-structure configuration. In some embodiments, one or more types of insulation may also be provided inside of the system's housings.

Figure 8:
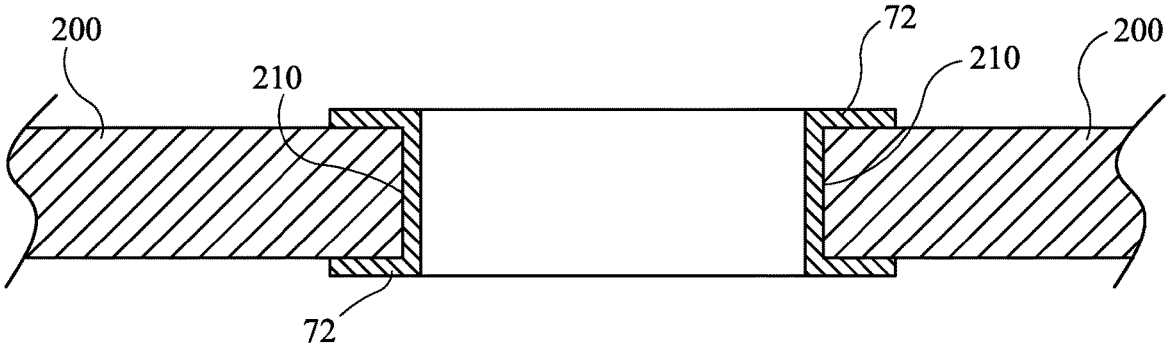
FIG. 8 is a cross-sectional view of a hole in an exterior-to-interior interface of a building having a guide disposed in the hole to facilitate maneuvering of a self-contained mini-split HVAC system in accordance with various aspects as described herein.

In some embodiments, some or all of the exterior of housings 20 and/or 30 may be configured and/or coated with a material that facilitates the maneuvering of the relevant housings through a building's interface hole as described above. In some embodiments, a guide may be installed in a building's interface hole where the guide is configured to facilitate the above-described maneuvering during an HVAC system installation. For example, FIG. 8 illustrates the inclusion of a guide sleeve 72 installed in a hole 210 of a building's interface 200. Guide sleeve 72 may be configured for reduced friction and/or mechanical guidance of a single-structure prefabricated HVAC system as it is maneuvered into position as described above.

Figure 9:
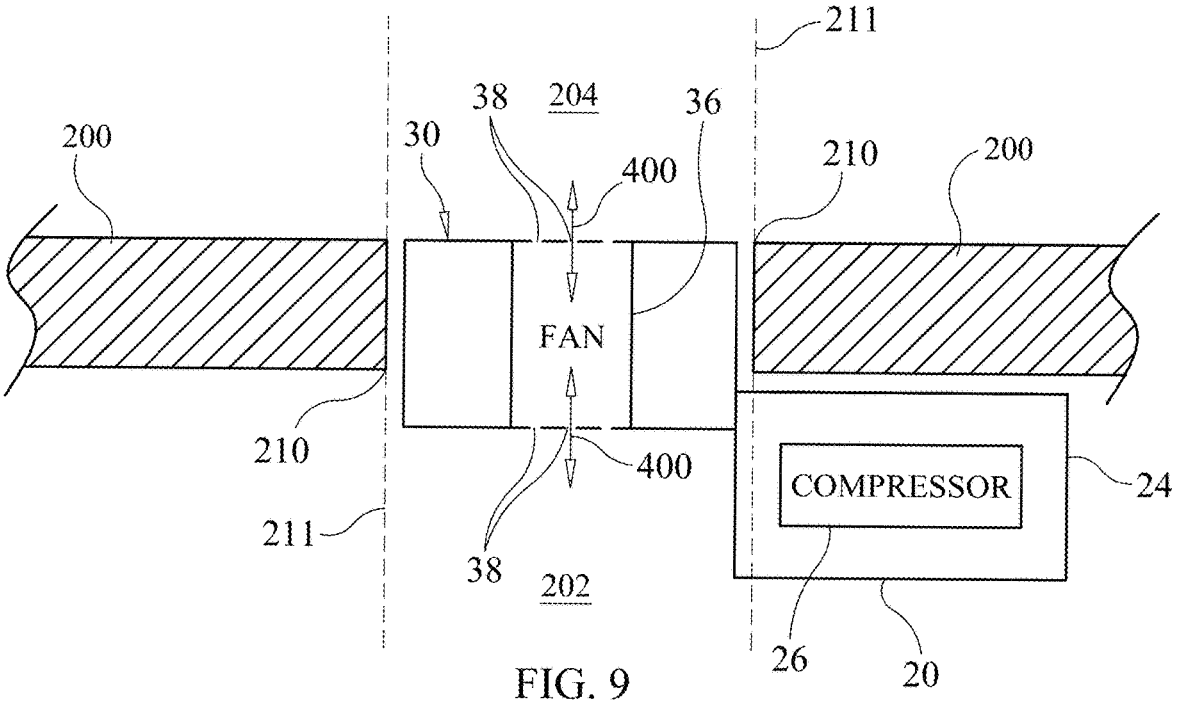
FIG. 9 illustrates another embodiment of an installed self-contained mini-split HVAC system incorporating a fan in the system's housing disposed in the building's interface in accordance with various aspects as described herein.

In some embodiments, it may be desirable to equip an HVAC system with a fan to cause an air flow between exterior region 202 and interior region 204. For example, FIG. 9 illustrates the inclusion of a fan 36 as part of the HVAC components disposed in housing 30, e.g., HVAC components 32 shown in FIGS. 1-3. More specifically, since fan 36 is aligned with hole 210, fan 36 may be operated to direct fresh air (e.g., via vents 38 in housing 30) from exterior region 202 to the interior region 204 or exhaust air from interior region 204 to exterior region 202 as indicated by two-headed flow arrows 400. In some embodiments, fan 36 may be configured as a modular component that is readily removable to provide for replacement, cleaning, access to other HVAC components in the system, etc.

As mentioned above, noise levels in interior region 204 and thermal efficiencies of the HVAC system may be improved by disposing the HVAC system's compressor in housing 20 which is two-dimensionally offset from housing 30 such that housing 20 is also offset with respect to hole 210 in interface 200. Accordingly, FIG. 9 also illustrates the inclusion of compressor 26 as part of the HVAC components disposed in housing 20, e.g., HVAC components 22 shown in FIGS. 1-3. Since compressor 26 is not aligned with hole 210 (i.e., not aligned along the straight-line projections 211 of hole 210 extending into exterior region 202 and interior region 204), noise and heat generated by compressor 26 are not readily transferred to interior region 204. In some applications, the configuration presented by HVAC system 12 (FIG. 3) may utilize the length of conduit 34 to increase the spacing between the system's compressor and hole 210.

Figure 10:
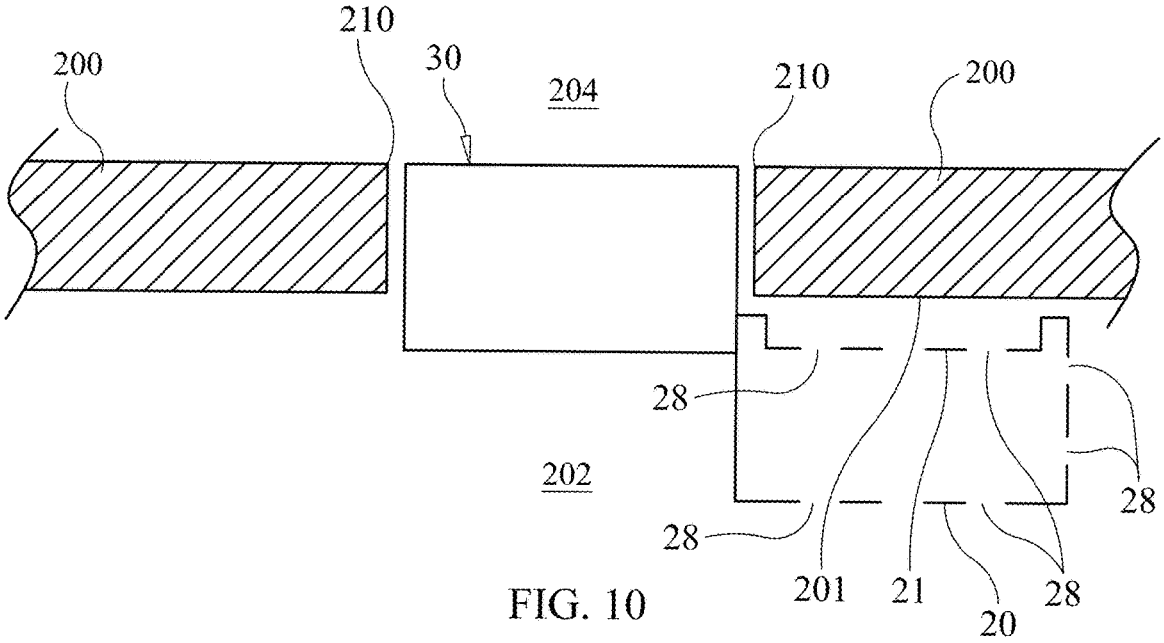
FIG. 10 illustrates another embodiment of a self-contained mini-split HVAC system in which the system's exterior housing has a portion that faces and is spaced-apart from the exterior of a building to improve the exterior housing's exposure to ambient air in accordance with various aspects as described herein.

In some embodiments, a self-contained mini-split HVAC system in accordance with the present disclosure may have its housing 20 configured with a portion spaced apart from the exterior of a building. Such spacing may increase the housing's exposure to ambient air thereby making the system's operation more efficient when ambient air is used in the HVAC's operation as is the case with a heat pump. For example and as illustrated in FIG. 10, a portion 21 of an HVAC's exterior housing 20 that faces the exterior 201 of interface 200 is configured to be spaced apart from the exterior 201 of interface 200. Vents 28 may be provided in housing 20 to include portion 21 to facilitate air flow into and out of housing 20. In addition to improving operational efficiency of the HVAC system, portion 21 may facilitate maneuvering of housing 20 through hole 210 during system installation.

It is to be understood that one or more of the various features described herein may be included in a self-contained mini-split HVAC system of the present disclosure. In addition, self-contained mini-split HVAC systems in accordance with the present disclosure could include a third housing coupled to housing 30 as will now be described with simultaneous reference to FIGS. 11-12. Provision of a third housing may provide a greater flexibility for distribution of the HVAC system's components as will be explained below.

Figure 11:
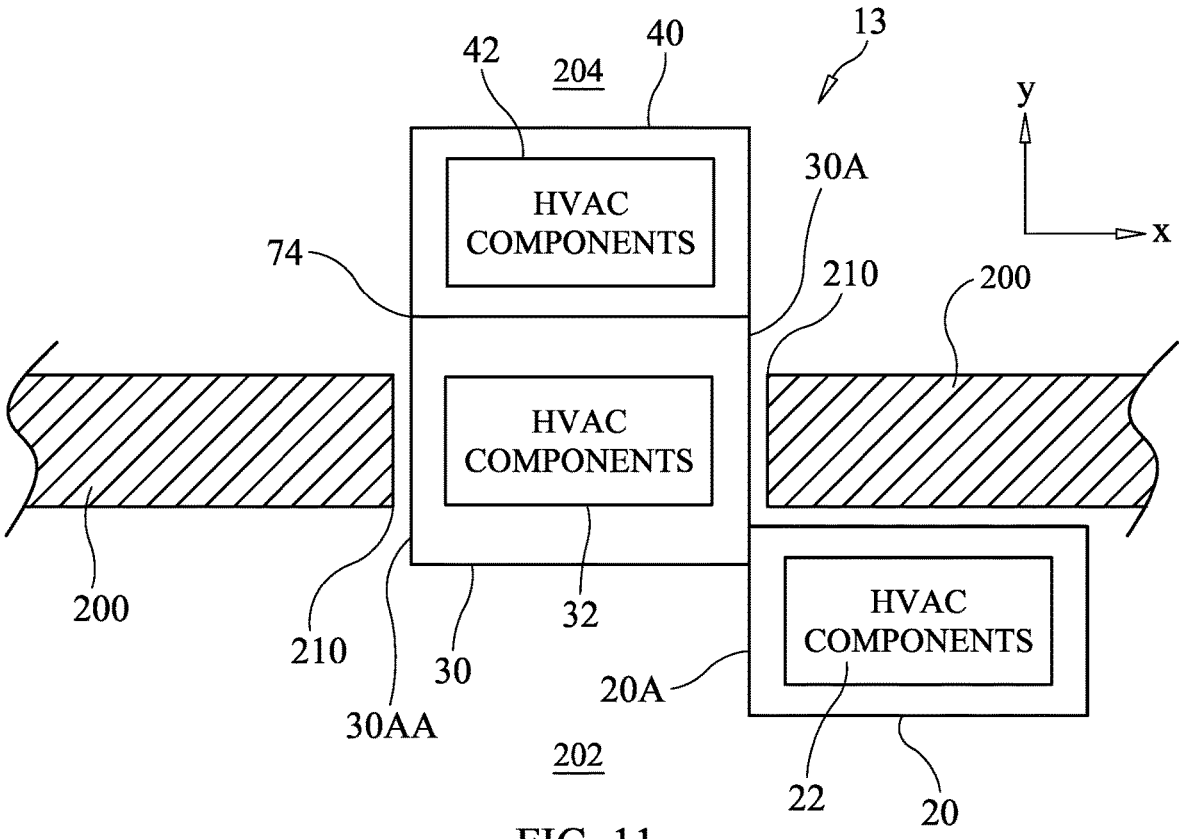
FIG. 11 is a schematic view of another embodiment of a self-contained mini-split HVAC system having three housings and illustrated after its installation in a solid exterior-to-interior interface of a building in accordance with various aspects as described herein.

Referring first to FIG. 11, a schematic view of another embodiment of a self-contained mini-split HVAC system having three coupled housings is illustrated after its installation in a solid exterior-to-interior interface 200 of a building in accordance with the present disclosure and is referenced generally by numeral 13. Similar to the above-described HVAC systems 10-12, HVAC system 13 is a single structure but has three housings 20, 30 and 40 arranged sequentially with HVAC components 22, 32 and 42 respectively disposed in the housings. For clarity of illustration, connections between the HVAC components are omitted from FIGS. 11-12. Briefly, housing 20 is disposed in exterior region 202 and is coupled to one end of housing 30 that is disposed in hole 210 as described above. Housing 40 is disposed in interior region 204 and is coupled to the other end of housing 30. For example, housings 20 and 30 may be adjacent, offset, and coupled to one another (e.g., attached to one another, integrated with one another, etc.) at side edges 20A and 30A, respectively, while housing 40 may be hingedly coupled to housing 30 at a hinge 74 such that housing 40 may rotate relative to housing 30 as indicated by rotational arrow 500. In some embodiments, housing 40 may also serve as an access door to housing 30 such that components in housing 30 and/or housing 40 may be cleaned, serviced, etc., when housing 40 is pivoted away from housing 30.

Figure 12:
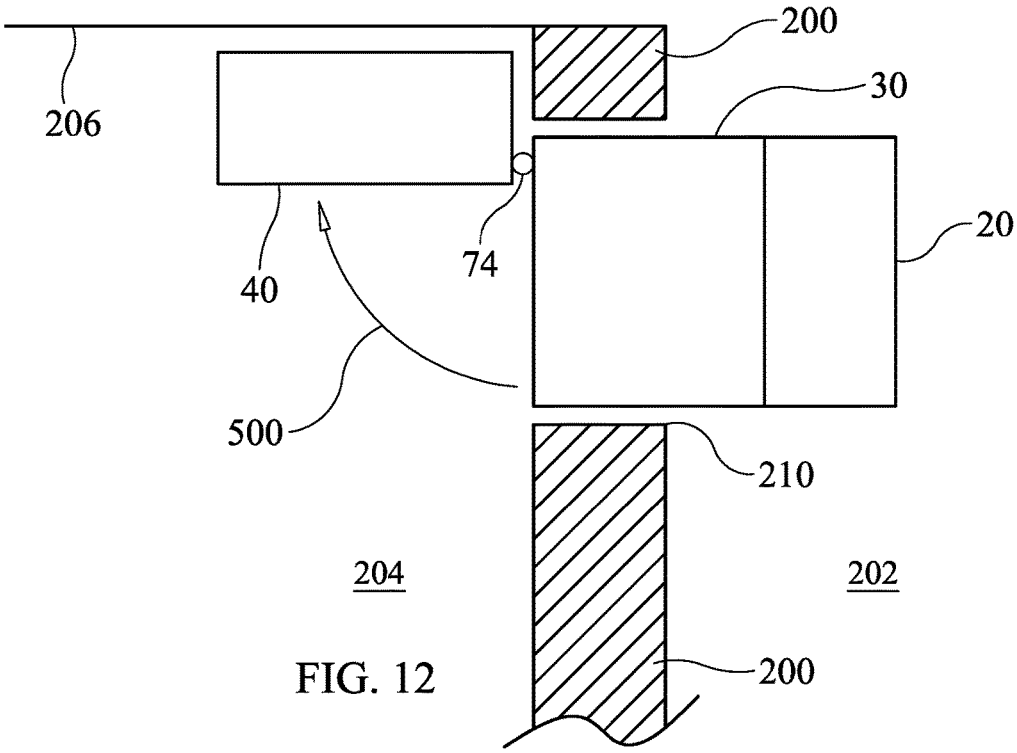
FIG. 12 illustrates a side view of the self-contained mini-split HVAC system shown in FIG. 11 in accordance with various aspects as described herein.

In the illustrated embodiment, housing 40 is disposed in interior region 204 and may be rotated into an operational position (as shown in FIG. 12) adjacent to a ceiling 206 in interior region 204. In this embodiment, the HVAC components (not shown in FIG. 12) associated with dispersing heated or cooled air into interior region 204 may be placed in housing 40 such that the heated or cooled air is dispensed into interior region 204 near ceiling 206. The types of hinge 74 are not limitations of the present invention. In addition, one or more hinges may be provided to improve one or more of packaging/shipping of the HVAC system, installation of the HVAC system, and/or operational functions of the HVAC system. For example, in some embodiments, hinge 74 may facilitate the positioning of housing 40 in an abutting relationship with housing 30 to facilitate packaging, installation, servicing, etc. of the HVAC system. In addition, it is to be understood that one or more of the various features described herein for the two-housing embodiment may be included in any of the three-housing embodiments of the present disclosure.

By providing for the distribution of the system's HVAC components between three housings (i.e., one in exterior region 202, one in hole 210, and one in interior region 204), HVAC system designers may locate the components to optimize one or more of system efficiency, system flexibility (e.g., locating a dedicated fresh-air fan in housing 30 that may be operated independently of the HVAC system's heating or cooling functions), ease of system installation, ease of system maintenance, etc.

Figure 13A:
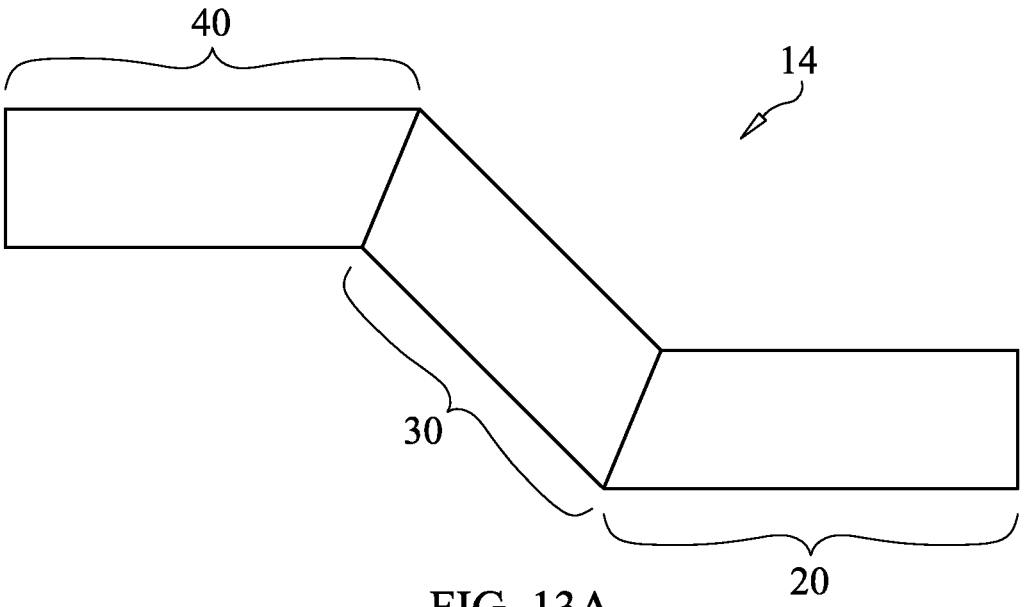
FIG. 13A illustrates another embodiment of a self-contained mini-split HVAC system in which the system's housings are arranged to trace an angular path in accordance with various aspects as described herein.
Figure 13B:
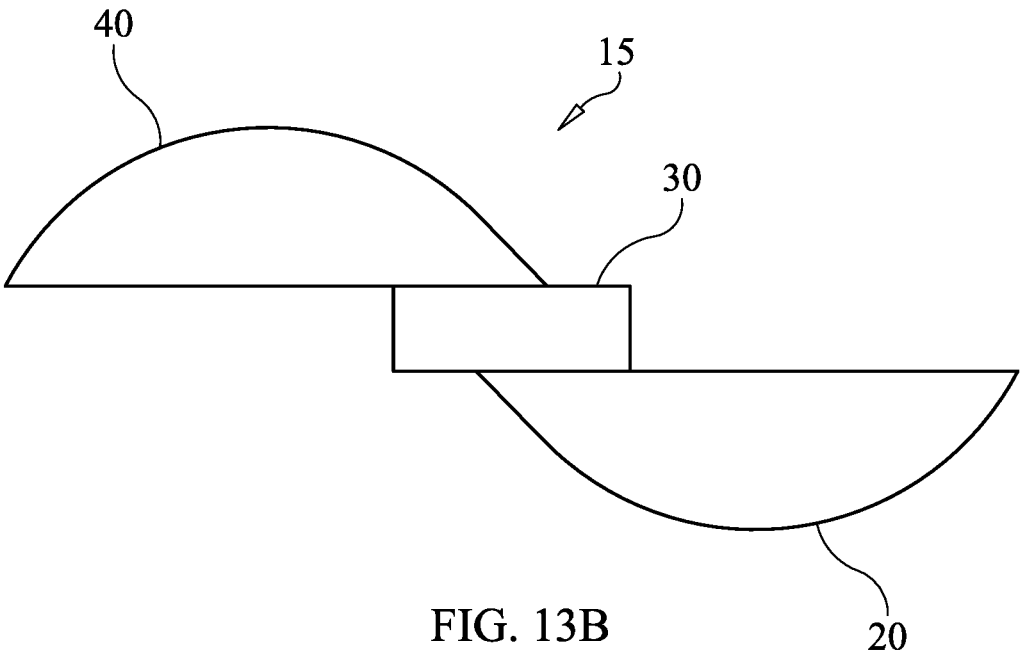
FIG. 13B illustrates another embodiment of a self-contained mini-split HVAC system in which the system's housings include semi-cylindrical housings in accordance with various aspects as described herein.

The previously-described embodiments of the HVAC system's single structure has housings 20 and 30 (and 30 and 40) disposed at a right angle to one another. However, HVAC systems in accordance with the present disclosure are not so limited. For example, FIG. 13A illustrates an embodiment of a single-structure HVAC system 14 whose housings 20/30 and housings 30/40 are disposed at angular relationships that are not defined by right angles. In some embodiments, the single-structure HVAC system may include curved-shaped housings. For example, FIG. 13B illustrates an embodiment of a single-structure HVAC system 15 whose housings 20 and 40 may be semi-cylindrical in shape. Housings 20 and 40 are offset from one another in two dimensions and are coupled using housing 30 that will reside in a building's interface/hole as described previously herein. Shaping of the housing structure in one of the above or other ways may be used for one or more of a variety of reasons to include to simplify maneuvering during installation, to accommodate HVAC component layouts and/or their modularity, to improve HVAC functionality, to accommodate the system's attachment to a building, to improve design aesthetics, to accommodate attachment of disparate or optional features to one or more of the housings, etc.

The advantages of the methods and systems disclosed herein are numerous. The prefabricated single-structure HVAC systems are completely self-contained in terms of their housing and operational components. The described offsets between housings provide for improvements in system efficiencies and/or noise reduction. The arrangement of HVAC components in the system's housings may be adapted to a particular application's needs, efficiencies, servicing ease, etc. The installation of the HVAC system is accomplished with a simple mechanical maneuvering of the system through a hole in a building's exterior-to-interior interface. The HVAC system may be installed horizontally or vertically. No duct work, electrical work, or refrigerant line connections/charging are required thereby making the HVAC system economical and efficient to install, while avoiding the inefficiencies associated with centralized and conventional mini-split HVAC systems requiring HVAC design and installation experts for their design/fabrication/ installation. The entire HVAC system may be constructed in a controlled factory setting thereby also ensuring system quality.

Although the methods and systems presented herein have been described for specific embodiments thereof, there are numerous variations and modifications that will be readily apparent to those skilled in the art in light of the above teachings. It is therefore to be understood that, within the scope of the appended claims, the methods and systems presented herein may be practiced other than as specifically described.

What is claimed as new and desired to be secured by Letters Patent of the United States is:

1. A self-contained heating, ventilation, and air conditioning (HVAC) system, comprising:

a single structure having a sequential arrangement of coupled housings, wherein at least two housings from said coupled housings are offset with respect to one another in two dimensions, said at least two housings including a first housing and a second housing, said second housing having opposing face edges, HVAC components disposed throughout and within said coupled housings, said HVAC components including operational components interconnected by lines including electrical lines and connected fully-charged fluid-carrying lines extending between said coupled housings, said operational components including a compressor disposed in said first housing, said second housing being adapted to reside in a hole in a solid exterior-to-interior interface of a building, wherein one of said opposing face edges of said second housing is directly exposed to air at an exterior of the building and another of said opposing face edges of said second housing is directly exposed to air at an interior of the building, and said first housing coupled to said second housing to position said first housing adjacent to the hole at the exterior of the building, wherein said compressor is fully offset with respect to the hole in said two dimensions and is completely out of alignment with the hole, and wherein said HVAC components are operable to generate at least one of heated air and cooled air.

2. The self-contained HVAC system of claim 1, wherein said coupled housings further include a third housing coupled to said second housing and adapted to be disposed at an interior of the building, wherein said second housing and said third housing are another two of said adjacent housings.

3. The self-contained HVAC system of claim 1, wherein said coupled housings comprise a rigid structure.

4. The self-contained HVAC system of claim 1, wherein said single structure includes at least one hinge operable to permit movement between two of said coupled housings.

5. The self-contained HVAC system of claim 1, wherein at least one of said coupled housings is dimensionally adjustable.

6. The self-contained HVAC system of claim 1, wherein said two dimensions are orthogonal to one another.

7. The self-contained HVAC system of claim 1, further comprising:

insulation adapted to be disposed in the hole adjacent to said second housing, said insulation including at least one of thermal insulation, moisture insulation, acoustic insulation, and vibration insulation.

8. The self-contained HVAC system of claim 1, further comprising:

a guide adapted to be disposed in the hole, said guide operable to support movement of said second housing in the hole.

9. The self-contained HVAC system of claim 1, wherein said second housing includes vents adapted to be disposed at a first opening of the hole at the interior of the building and a second opening of the hole at the exterior of the building, wherein said HVAC components include a fan disposed in said second housing, and wherein said fan is operable to cause an air flow between the interior of the building and the exterior of the building by directing the air flow through said second housing via said vents.

10. The self-contained HVAC system of claim 1, wherein said first housing includes a face opposing the exterior of the building, said face being shaped to include a portion spaced apart from the exterior of the building when the second housing resides in the hole, wherein said portion includes vents.

11. A self-contained heating, ventilation and air conditioning (HVAC) system, comprising:

a prefabricated single structure adapted for partial disposition in a hole in a solid exterior-to-interior interface of a building wherein, prior to the partial disposition in the hole, said prefabricated single structure including a sequential arrangement of coupled housings, wherein at least two adjacent housings from said coupled housings are offset with respect to one another in two dimensions, said at least two adjacent housings including a first housing attached to a second housing, said second housing having opposing face edges, HVAC components disposed throughout and within said coupled housings, said HVAC components including operational components interconnected by lines including electrical lines and connected fully-charged fluid-carrying lines extending between said coupled housings, wherein said HVAC components are operable to generate at least one of heated air and cooled air, and said operational components including a compressor disposed in said first housing, wherein, after the partial disposition of said prefabricated single structure in the hole with said first housing being adjacent to the hole and said second housing being in the hole, wherein one of said opposing face edges of said second housing is directly exposed to air at an exterior of the building and another of said opposing face edges of said second housing is directly exposed to air at an interior of the building, wherein said first housing and said second housing position said compressor at an exterior of the building, and wherein said compressor is fully offset with respect to the hole in said two dimensions and is completely out of alignment with the hole.

12. The self-contained HVAC system of claim 11, wherein said coupled housings further include a third housing coupled to said second housing and adapted to be disposed at an interior of the building, wherein said second housing and said third housing are another two of said adjacent housings.

13. The self-contained HVAC system of claim 11, wherein said coupled housings comprise a rigid structure.

14. The self-contained HVAC system of claim 11, wherein said prefabricated structure includes at least one hinge operable to permit movement between two of said coupled housings.

15. The self-contained HVAC system of claim 11, wherein at least one of said coupled housings is dimensionally adjustable.

16. The self-contained HVAC system of claim 11, wherein said two dimensions are orthogonal to one another.

17. The self-contained HVAC system of claim 11, further comprising:

insulation adapted to be disposed in the hole adjacent to said second housing, said insulation including at least one of thermal insulation, moisture insulation, acoustic insulation, and vibration insulation.

18. The self-contained HVAC system of claim 11, further comprising:

a guide adapted to be disposed in the hole, said guide operable to support movement of said second housing in the hole.

19. The self-contained HVAC system of claim 11, wherein said second housing includes vents adapted to be disposed at a first opening of the hole at the interior of the building and a second opening of the hole at the exterior of the building, wherein said HVAC components include a fan disposed in said second housing, and wherein said fan is operable to cause an air flow between the interior of the building and the exterior of the building by directing the air flow through said second housing via said vents.

20. The self-contained HVAC system of claim 11, wherein said first housing includes a face opposing the exterior of the building, said face being shaped to include a portion spaced apart from the exterior of the building after the partial disposition of said prefabricated single structure in the hole, wherein said portion includes vents.

21. A self-contained heating, ventilation, and air conditioning (HVAC) system, comprising:

a single structure having a sequential arrangement of coupled housings to include a first housing and a second housing, said second housing having opposing face edges and opposing side edges, said first housing coupled to said second housing only at a portion of one of said opposing side edges, and wherein said first housing and said second housing are offset with respect to one another in two dimensions, HVAC components disposed throughout and within said coupled housings, said HVAC components including operational components interconnected by lines including electrical lines and connected fully-charged fluid-carrying lines extending between said first housing and said second housing, said operational components including a compressor disposed in said first housing, and said second housing being adapted to reside in a hole in a solid exterior-to-interior interface of a building wherein, when said second housing resides in the hole, said portion of one of said opposing side edges is positioned at an exterior of the building and said first housing is adjacent to the hole at the exterior of the building, one of said opposing face edges is directly exposed to air at the exterior of the building, another of said opposing face edges is directly exposed to air at an interior of the building, and said compressor is fully offset with respect to the hole in said two dimensions and is completely out of alignment with the hole.

* * * * *